US006412116B1

(12) United States Patent
Clark

(10) Patent No.: US 6,412,116 B1
(45) Date of Patent: Jul. 2, 2002

(54) ARTICLE WITH MAGNETIC COLLAR CLOSURE

(76) Inventor: Wayne Clark, c/o West Coast Beauty Supply, 5001 Industrial Way, Benicia, CA (US) 94510

( * ) Notice: Subject to any disclaimer, the term of this patent is extended or adjusted under 35 U.S.C. 154(b) by 0 days.

(21) Appl. No.: 09/945,268

(22) Filed: Aug. 31, 2001

(51) Int. Cl.[7] ..... A41B 3/00
(52) U.S. Cl. ..... 2/129; 24/303
(58) Field of Search ..... 2/98, 129, 46, 2/50, 51, 159, 162, 167, 69, 104, 88, 247, 16, 123, 127, 128, 310–311, 321, 338; 24/66.1, 303

(56) References Cited

U.S. PATENT DOCUMENTS 3,161,932 A * 12/1964 Russell ..... 24/303
3,827,019 A * 7/1974 Serbu ..... 335/285
4,399,595 A * 8/1983 Yoon et al. ..... 24/201 B
4,987,612 A * 1/1991 Middleton ..... 2/104
5,950,235 A * 9/1999 Tata ..... 2/48
6,035,449 A * 3/2000 Galler et al. ..... 2/249
6,226,842 B1 * 8/2001 Wong ..... 24/303

* cited by examiner

*Primary Examiner*—Gloria M. Hale
*Assistant Examiner*—Tejash Patel
(74) *Attorney, Agent, or Firm*—Joseph L. Strabala, Esq.

(57) ABSTRACT

An article, such as a cape, with an adjustable magnetic collar closure includes an cloth portion having a collar formed therein with pockets formed in each end of the collar, a flexible magnetic strip inserted into one of the pockets and a separate flexible magnetic strip inserted into the other pocket whereby over lapping said magnetic strips inserted into the pockets of the collar will hold said collar closed around the neck of a person using the article due to magnetic attraction between said strips clamping the fabric of the cape there between. The article or cape may include means for releaseably retaining the magnetic strips in the pockets whereby these strips can be removed when the article is laundered, or closures for permanently retaining the magnetic strips in the pockets of the collar of the article.

4 Claims, 3 Drawing Sheets

ARTICLE WITH MAGNETIC COLLAR CLOSURE

BACKGROUND

In the beauty salon or the barber shop, customers are often fitted with a cape while their hair is done or cut. Typically these capes have string ties or Velcro® closures at the collar so they can be snugly secured around the neck of the customer. The Velcro® closures on such articles are particularly bad because hair becomes lodged in the hooks and loops of the Velcro® making the capes unsanitary for subsequent use. On the other hand the string tie type closures are unsatisfactory because they are not fully adjustable.

Such prior capes whether using the ties to close the cape around the neck or Velcro® strips to close the cape around the neck must be washed after each use to comply with health regulations which often results in the further matting of the hooks and loops of the Velcro® and damage to the string ties on the cape from multiple launderings.

According to this invention these problems can be avoided by incorporating flexible strips of magnetic material in the collar of the cape with one lapel of the cape having the north pole of a strip of magnetic material just under the outside surface of the cape lapel and the other lapel of the cape having the same pole of a separate strip of magnetic material disposed just under the outside surface of the cape lapel. With this arrangement the collar of the cape can be closed to the desired degree about the neck of the customer and snugly held by the interaction of the magnetic strips in the opposing lapels of the cape. Moreover, the novel cape is fully adjustable around the user's neck and can be washed without problems experienced with the prior art capes using string ties or Velcro® closures.

Also it matters not which lapel of the cape is on top of the lapped lapels, as this closure will hold the lapels of the cape together no matter which lapel is used to lap the other if the poles of the magnetic material are arranged as described above.

Magnetic buttons such as disclosed in the prior art, see U.S. Pat. No. 6,226,842 issued to Wong, U.S. Pat. No. 4,736,949 issued to Marchesi and U.S. Pat. No. 4,924,559 issued to Marchesi, are not satisfactory as they cannot provide the unlimited adjustment that this novel invention provides. In addition by placing the magnetic strips under the cloth surfaces of the cape lapels, the cloth from opposite sides of the cape will be sandwiched between the strips providing a frictional engagement that prevents slippage between the strips. Magnetic buttons often use mechanical interlocks to avoid this weakness (slippage) of such magnetic buttons when they are engaged. Moreover such magnetic buttons are expensive and costly to incorporate into inexpensive capes of the type to which this invention applies.

Other advantages of the novel invention will be apparent from the description in and drawings of this specification.

SUMMARY OF THE INVENTION

A article with an adjustable magnetic collar closure includes a cloth portion having a collar formed therein with pockets formed in each end of the collar, a flexible magnetic strip inserted in one end of the pockets and a separate flexible magnetic strip inserted in the other end of the pocket whereby over lapping said magnetic strips inserted into the pockets of the collar will hold said collar snugly closed around the neck of a person using the article due to magnetic attraction between said strips. The article may include means for releaseably retaining the magnetic strips in the pockets whereby these strips can be remove when the cape is laundered, or closures for permanently retaining the magnetic strips in the pockets.

DESCRIPTION OF THE DRAWINGS

The invention will be better understood by reference to the attached drawing in conjunctions with this written specification, wherein.

DESCRIPTION OF AN EMBODIMENT OF THE INVENTION

Figure 1:
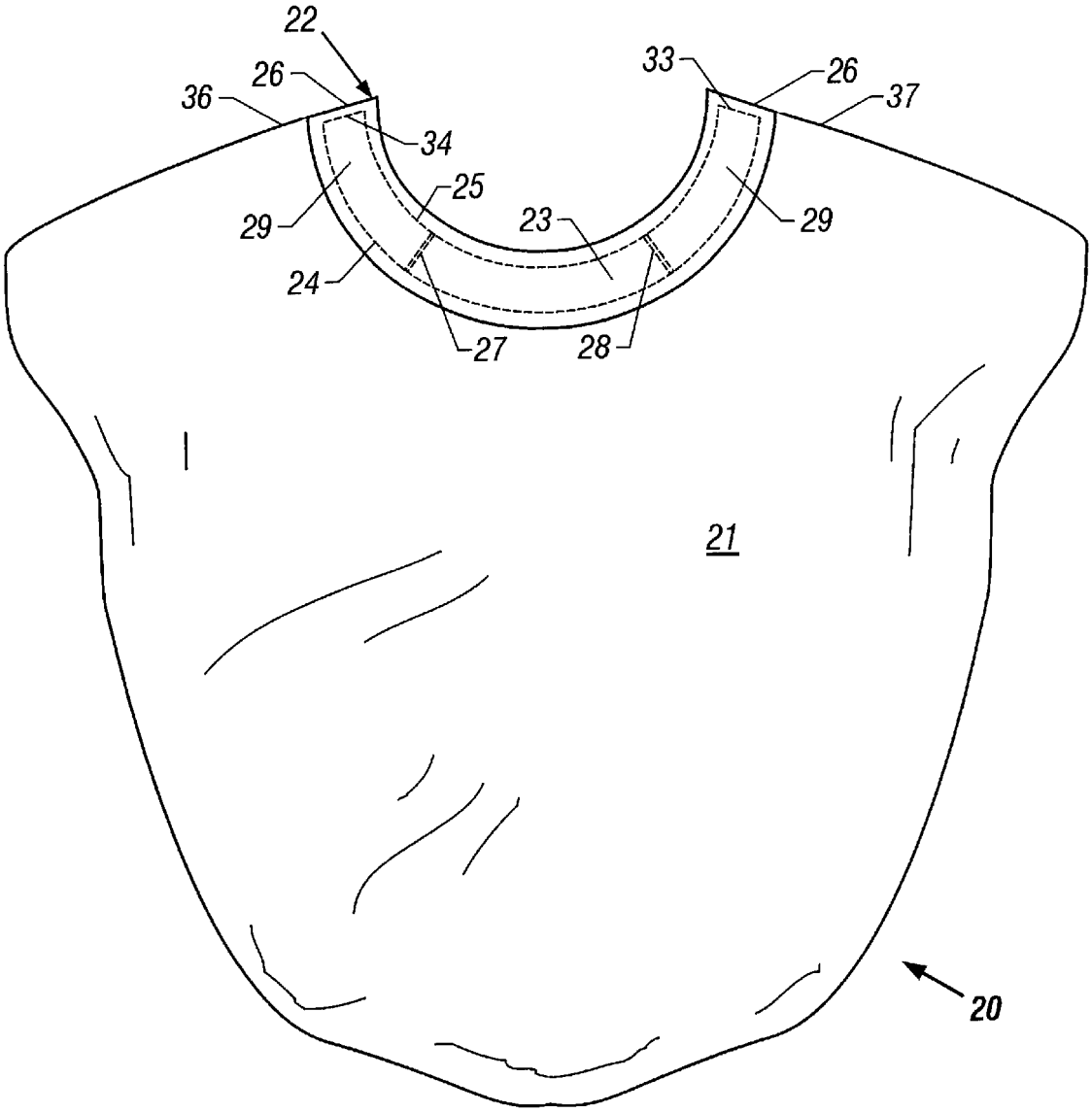
FIG. 1 is a plan of a cape having the adjustable magnetic closure incorporated therein.

In FIG. 1 a typical cape 20 which can be used to practice the invention is shown but it should be understood that the invention is applicable to similar articles of differing configurations and the cape illustrated is merely exemplary of an article to which the invention may be applied. It includes a cape portion 21 which can be chosen from a variety of fabrics, such as polyester, nylon or the like and includes a collar 22 which is usually formed by folding a portion 23 of the cape about the collar so that it laps the main portion of the cape. Once this folding step is completed the overlapping materials are stitched with seams 24 and 25 which forms a continuous tube in the collar. Adjacent to the distal ends 26 of the collar (about six to eight inches therefrom) this tube is cross stitched with seams 27 and 28 to form distal pockets 29 in the ends of the collar.

Figure 2:
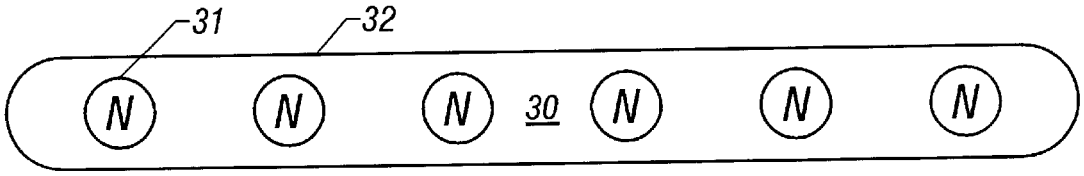
FIG. 2 is a plan of one embodiment of a flexible magnetic strip which can be used in the practice of the invention showing individual disk magnets encased in a silicone band to form the flexible strip.
Figure 3:
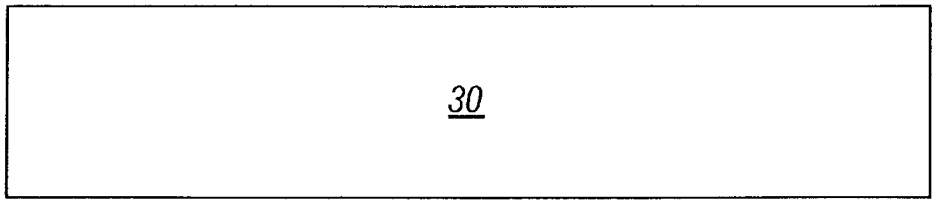
FIG. 3 is a plan a magnetic strip cut from a commercially available magnetic sheet material which can be also be used in the practice the invention.

Next flexible strips 30 of magnetic material are inserted into the pockets 29 of the cape 20, which strips are shown in FIG. 2 and 3. In a preferred embodiment for these strips, as shown in FIG. 2, disk magnets 31 are encapsulated in a silicone band 32 to provide a highly flexible strip. An alternative strip is shown in FIG. 3 wherein magnetic powder is incorporated into rubbers and the like. Ferrite flexible magnets so formed have existed as a product for over 25 years. More recently, rare earth powders have been used in flexible bonded material to form such flexible magnets. Magnetic sheet material suitable for use in this invention is available from Arnold Group located at 300 N. West Street, Marengo, Ill. and on the net at www.grouparnold.com. Such calendered sheets often use polyethylene binders and rare earth metal powder to provide stronger magnetic interaction when it is desired. Newer formulations with nitrile rubber binders are also available. These sheets can be cut into strips of the desired profile and inserted into the several pockets in the cape. Typically the strips shown in FIGS. 2 and 3 are approximately seven inches long and have a width of less than one inch, and a thickness of less than one eighth of an inch, usually around a sixteenth of an inch. It is critical that the strips be flexible enough so that when the novel cape is place about the neck of a user the strips in pockets will conform to the neck of such a user.

Figure 4:
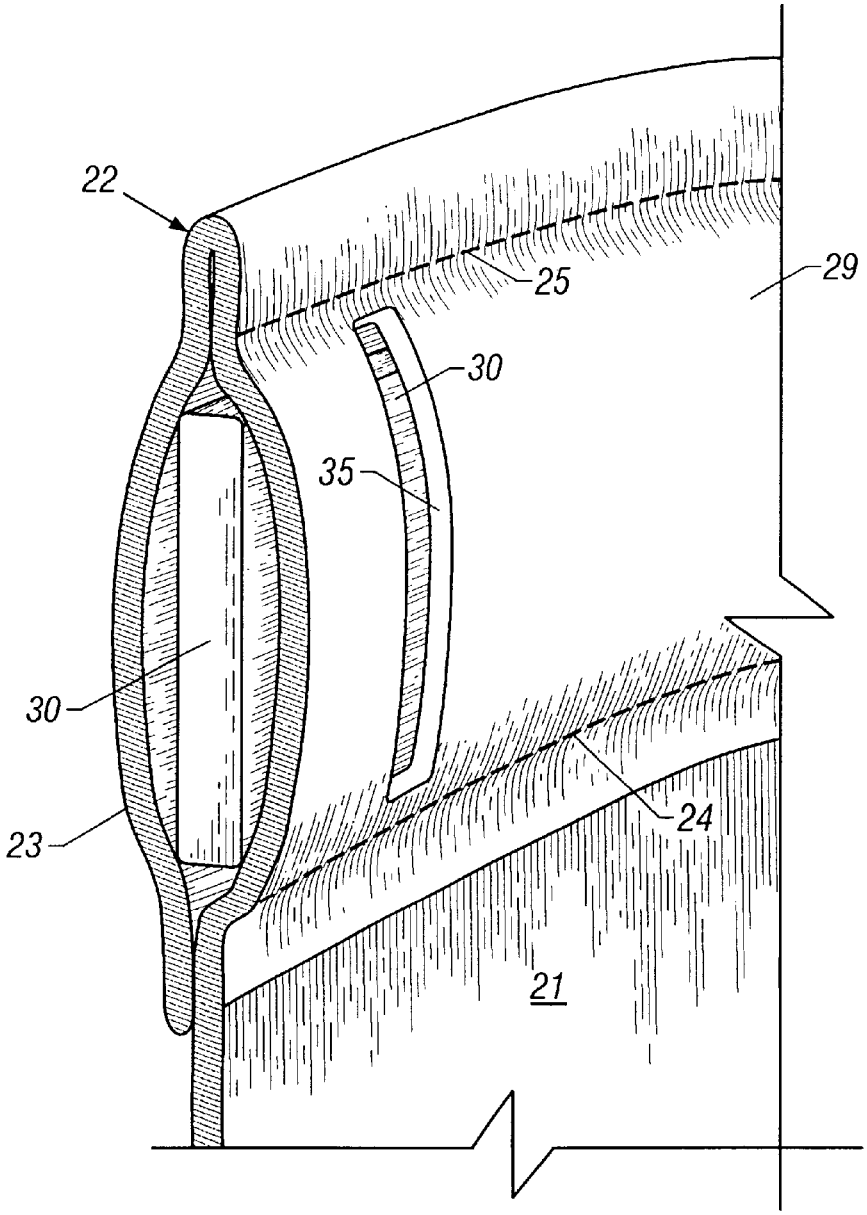
FIG. 4 is a perspective of the collar of the novel cape showing an elongated aperture through which a magnetic strip incorporated in the collar of the cape can be removed when the cape is laundered with parts of the cape broken away and part sectioned.

As can be appreciated disk magnets encapsulated in a silicone band to form a flexible strip 30 or the commercially available flexible magnets 30 are not affected by contact with water and will not be degraded by multiple washing of a cape 20 in which they have been incorporated according to this invention. As a result once these strips are inserted in pocket 29 the outboard ends of these pockets can be permanently closed by seams 33 and 34 as shown in FIG. 1. In the alternative these strips may be releaseably retained in their respective pockets, which will enable the user to remove the strips when the cape is laundered. One technique is to provide a slit 35 in the pocket close to the distal end 26 of the collar 22 as shown in FIG. 4. Other means providing for releasably retaining the strips in the pockets are within the contemplation of this invention, such as sizing the pockets so that the strips have a slight interference fit and are retained in the pockets even though the ends are not sewn closed. In fact the cape can be fabricated without the seams 33 and 34 shown in FIG. 1, which close the distal ends of the several packets, as the strips will often be retained in the pockets by friction against their surfaces of the fabric of which the cape is constructed.

In the embodiment of the invention shown in FIG. 4 the magnetic strips 30 can be removed from the cape 20, and thereafter they can be placed in a antiseptic solution while the cape is laundered and then re-inserted after the cape is washed. This embodiment avoids the problem of the magnetic strips adhering to the washing machine and or other capes while being being laundered. However, this is not a problem of a magnitude that prevents the strips from being permanently incorporated in the collar of the cape.

As to the magnetic strips 30 they are fashioned so that their planner surfaces are either the north pole or the south pole. In the strip using the disk magnets shown in FIG. 2 this is accomplished by orienting all of the magnets in the strip with a common pole facing up; in the illustration shown FIG. 2 with the north pole up indicated by the letter "N".

Both strips used for the cape 20 are preferably inserted into pockets 29 so they are oriented with a common pole, either the north or the south pole, of the strip just under the outer surface of the cape forming the pocket 29. With this orientation, either lapel 36 or 37 of the cape can be lapped on the other with the magnetic strips in the collar 22 lapped with one another whereby the magnetic interaction of the strips will hold the collar closed.

Figure 5:
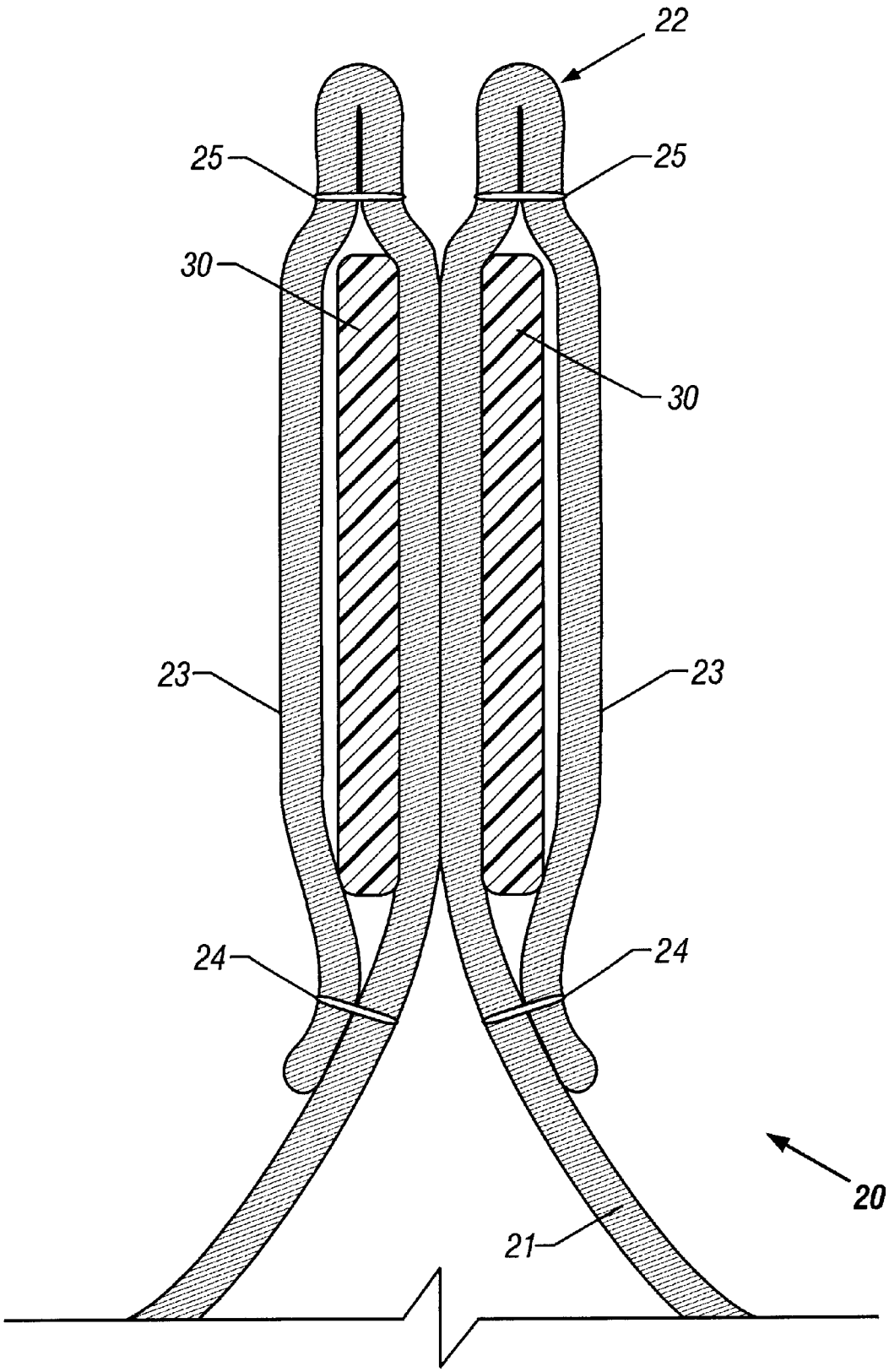
FIG. 5 is cross section of the collar of the cape in the closed position showing how the material of the cape is clamped between the magnetic strips due to the magnetic interaction therebetween.

FIG. 5 illustrates the feature that gives the cape 20 the ability to retain the cape 20 snugly about the neck of a customer or user. As can be seen in this Figure the magnetic strips 30 sandwich the fabric from opposite sides of the collar 22 between them. As a result the friction of fabric on fabric between the strips ensures that the cape will remain closed, unless ususal force is applied. In fact this feature allows the cape to be firmly secured snugly around the neck in a manner that water will not penetrate around the collar if desired which is especially useful when the cape is formed of a waterproof fabric and employed when the user's hair is shampooed (washed). Moreover, then the lapped end of the collar is lifted away from the portion underlying it, it is easy to remove the cape from around the neck of the user, another feature of this invention.

It should be kept in mind that while the invention has been described as a closure for a cape it may have other applications exploiting the feature described in the forgoing paragraph.

Having described my invention, I claim:

1. An article with a magnetic collar closure comprising:

a cloth portion having a collar formed therein, said collar having distal ends;

a pocket formed in each of said distal ends of said collar;

a flexible magnetic strip in said pocket at one of said distal ends of said collar; and a separate flexible magnetic strip in said pocket at said other distal end of said collar with magnetic poles of both of said magnetic strips having a common orientation with respect to a common surface of said article whereby over lapping said magnetic strips in said pockets will hold said collar closed around the neck of a person using said article.

2. The article defined in claim 1 wherein at least one of the pockets in the distal ends of the collar has closure means operable to open said associated pocket to remove the flexible magnetic strip in said associated pocket during cleaning said article and to close said associated pocket after said magnetic strip is inserted therein.

3. The article defined in claim 1 wherein the flexible magnetic strips used in the collar are formed by a linear placement of disk magnets in a silicone band with their magnetic poles having a common orientation with respect to a surface of said band so said disk magnets are totally encapsulated in said silicone band.

4. The article defined in claim 1 wherein the article is a cape.

* * * * *